US005617084A

United States Patent [19]

Sears

[11] Patent Number: 5,617,084

[45] Date of Patent: Apr. 1, 1997

[54] APPARATUS FOR COMMUNICATING UTILITY USAGE-RELATED INFORMATION FROM A UTILITY USAGE LOCATION TO A UTILITY USAGE REGISTERING DEVICE

[76] Inventor: Lawrence M. Sears, 45006 Mather La., Hunting Valley, Ohio 44022

[21] Appl. No.: 547,408

[22] Filed: Oct. 24, 1995

Related U.S. Application Data

[63] Continuation of Ser. No. 119,986, Sep. 10, 1993, abandoned.

[51] Int. Cl.[6] ..... G08C 19/00

[52] U.S. Cl. ..... 340/870.02; 340/870.11; 340/870.17; 340/825.54; 340/637; 455/54.2

[58] Field of Search ..... 340/870.01–870.03, 340/870.11–870.17, 825.69, 825.72, 825.54, 637; 455/49.1, 53.1, 54.1, 54.2

[56] References Cited

U.S. PATENT DOCUMENTS

| | | | |
|---|---|---|---|
| 2,962,702 | 11/1960 | Derr et al. | 340/870.02 |
| 3,114,900 | 12/1960 | Anderson | 340/870.03 |
| 3,588,825 | 6/1971 | Shook | 340/870.02 |
| 3,656,112 | 4/1972 | Paull | 340/870.02 |
| 3,705,385 | 12/1972 | Batz | 340/870.02 |
| 4,057,785 | 11/1977 | Furniss et al. | 340/870.15 |
| 4,119,948 | 10/1978 | Ward et al. | 340/870.02 |
| 4,254,472 | 3/1981 | Juengel et al . | 340/870.03 |
| 4,396,915 | 8/1983 | Farnsworth et al. | 340/870.03 |
| 4,408,204 | 10/1983 | Salvesen | 340/870.02 |
| 4,463,354 | 7/1984 | Sears | 340/870.02 |
| 4,504,831 | 3/1985 | Jahr et al. | 340/870.03 |
| 4,614,945 | 9/1986 | Brunis et al. | 340/870.03 |
| 4,685,149 | 8/1987 | Smith et al. | 455/56 |
| 4,799,059 | 1/1989 | Grindahl et al. | 340/870.03 |
| 4,850,010 | 7/1989 | Stanbury et al. | 379/107 |
| 4,878,236 | 10/1989 | Ray et al. | 379/37 |
| 4,940,976 | 7/1990 | Gastouniotis et al. | 340/870.02 |
| 5,056,107 | 10/1991 | Johnson et al. | 375/1 |
| 5,086,292 | 2/1992 | Johnson et al. | 340/637 |
| 5,194,860 | 3/1993 | Jones et al. | 340/870.02 |
| 5,432,507 | 7/1995 | Mussino et al. | 340/870.03 |
| 5,438,329 | 8/1995 | Gastouniotis et al. | 340/870.02 |
| 5,448,230 | 9/1995 | Schanker et al. | 340/870.03 |
| 5,488,565 | 1/1996 | Kennon et al. | 364/483 |

OTHER PUBLICATIONS

Technopress Ltd., "Meter Reading Information," copyright 1989, pp. 69–82.

American Meter Company, "Information on Trace Automated Systems," 1990.

IDSystems, "Nonstop Meter Reading," Jan. 1993.

Datamatic, Inc., "Walk–By," Jul. 1990.

Schlumberger Industries, "ProRadio Remote Meter Reading Systems," May 1993.

Water and Waste Digest, "Here's How It Works," May–Jun. 1993.

*Primary Examiner*—Glenton B. Burgess

[57] ABSTRACT

An apparatus for communicating utility usage information at a utility usage location to a utility usage registering device includes a utility usage registering module adapted to be located at a utility usage location to provide a first signal indicative of the utility usage information, a transmitter responsive to said first signal for periodically transmitting at a pseudo-random transmission intervals, a second signal indicative of utility usage, a receiver located remote from the utility usage location for receiving the second signal, and a utility usage registering device associated with the receiver for storing the second signal indicative of utility usage information. A tamper detector is provided to detect the occurrence of a tamper event and generates a tamper signal which is directed to the utility usage registering module. The tamper signal is indexed upon the tamper detector sensing the occurrence of each tamper event.

9 Claims, 5 Drawing Sheets

APPARATUS FOR COMMUNICATING UTILITY USAGE-RELATED INFORMATION FROM A UTILITY USAGE LOCATION TO A UTILITY USAGE REGISTERING DEVICE

This application is a continuation of application Ser. No. 08/119,986 filed on Sep. 10, 1993, abandoned.

TECHNICAL FIELD

The present invention relates to a method and apparatus for communicating utility usage-related information from a utility usage location to a utility usage registering device and more particularly, to an economical method and apparatus for communicating utility usage related information from a utility meter to a utility usage registering device which can be handheld or located in a vehicle to read the utility usage-related information from a plurality of utility meters.

BACKGROUND OF THE INVENTION

Meter reading systems for reading utility usage at a utility usage registering device are well known. An example is disclosed in the Sears U.S. Pat. No. 4,463,354 entitled Apparatus for Communicating Utility Usage Related Information from a Utility Usage Location to a Portable Utility Usage Registering Device. Other types of utility meter reading systems are known which transmit via radio frequency or which transmit to a central location via phone lines or other hard wired devices.

The prior art suffers from the disadvantage that the meter reading devices are costly and costly installation and hard wiring may be required.

In the prior art radio transmitter meter reading systems, a meter reader would transmit a signal which would "wake up" a particular meter transponder or a group of meter transponders to cause the transmitter at the meter to send back meter information, such as account numbers, utility usage, etc. Such a system utilizes a receiver at the meter, which is ON continuously to receive the "wake up" signal. Receivers add to the cost of the device and increase the energy consumption, which is particularly disadvantageous when battery power is required. Elimination of a receiver at the meter location renders the utility usage registering device much less expensive than the prior art devices and reduces battery drain.

It is desirable to provide an inexpensive apparatus and method for communicating utility usage information to a utility usage registering device which utilizes low cost components and which is still operable to transmit over a fixed, accurately controlled frequency which is assigned by the FCC.

It is known for prior art utility meters to include tamper and leak detectors. However, some of the prior art detectors are actuated to a predetermined condition upon the occurrence of a tamper or leak event and must be reset to register the next event. Such a tamper or leak device cannot be reset except if a receiver or a manual reset means is provided at the meter module.

In addition, it is desirable to provide a method and apparatus for communicating utility usage information from a plurality of utility usage locations to a single utility usage registering device where CLASH (or the reception of simultaneous transmissions) among the plurality of meter modules is minimized by controlling the sensitivity of the receiver and transmitting the utility usage information at a pseudo-random interval.

SUMMARY OF THE INVENTION

The present invention relates to a new and improved apparatus for communicating utility usage related information from a utility usage location to a utility usage registering device wherein no receiver is utilized at the utility usage location, an economical and environmentally resistant structure is provided at the utility usage location, energy consumption is minimized and CLASH is minimized at the receiver for receiving the utility usage related information.

The present invention provides a new apparatus for communicating utility usage information at a utility usage location to a utility usage registering device, including a first means adapted to be located at the utility usage location for providing a first signal indicative of utility usage information, transmitter means responsive to the first signal for periodically transmitting at a pseudo-random transmission interval, a second signal which is indicative of utility usage information, receiver means located remote from the utility usage location for receiving the second signal, and a utility usage registering device associated with the receiver for storing the information indicative of utility usage.

A further provision of the present invention is to provide an apparatus for communicating utility usage information to a utility usage registering device, including first means adapted to be located at the utility usage location providing a first signal indicative of utility usage, microprocessor means for storing the first signal, and transmitter means connected to the microprocessor for periodically transmitting at a pseudo-random transmission interval a second signal to a utility usage registering device.

Still another provision of the present invention is to provide an apparatus for communicating utility usage information to a utility usage registering device as set forth in the preceding paragraph, further including leak detection means for determining if leakage is present at the utility usage location.

Still another provision of the present invention is to provide an apparatus for communicating utility usage information at a utility usage location to a utility usage registering device, including first means adapted to be located at the utility usage location providing a first signal indicative of utility usage, a microprocessor for storing the first signal, and a temperature compensated transmitter means connected to the microprocessor for periodically transmitting a second signal to a utility usage registering device which is indicative of the utility usage at the utility usage location.

Still another provision of the present invention is to provide a new and improved apparatus for communicating utility usage information to a utility usage registering device as set forth in the preceding paragraph, further including temperature sensitive means for generating a temperature signal indicative of the temperature of the transmitter means, the microprocessor storing data therein indicative of a plurality of temperature compensated signals to be directed to the transmitter means to enable the transmitter means to transmit the second signal at an accurate predetermined frequency and wherein the microprocessor means receives the temperature signal and generates a temperature compensated signal from the data in the microprocessor means.

A further provision of the present invention is to provide a battery operated apparatus for communicating utility usage information to a utility usage registering device, including first means energized by the battery for providing a first signal indicative of utility usage, a tamper detector associated with the first means for detecting the occurrence of a tamper event at the utility usage location and generating a tamper signal to the first means, the tamper signal being indexed upon the occurrence of each tamper event, microprocessor means for storing the first signal, and transmitter means powered by the battery and connected to the microprocessor for periodically transmitting a second to a utility usage registering device which is indicative of the utility usage and the indexed tamper signal.

Another provision of the present invention is to provide an apparatus for communicating utility usage information at a utility usage location to a utility usage registering device including first means for providing a first signal indicative of utility usage, microprocessor means responsive to the first signal, transmitter means having an antenna connected to the microprocessor means for periodically transmitting on the antenna a second signal to a utility usage registering device, an inductive loop coupler including a first inductive loop connected to the output of the transmitter means and a second inductive loop connected to the antenna, a first housing for supporting the first inductive loop therein which is sealed to protect the first inductive loop from environmental degradation, a second housing for supporting said second inductive loop and being sealed to protect the second inductive loop from environmental degradation, and wherein the first housing is adapted to be disposed contiguous to the second housing to couple the first inductive loop to the second inductive loop to enable the inductive loop coupler to connect the output of the transmitter means to the antenna.

DESCRIPTION OF THE PREFERRED EMBODIMENT

Figure 1:
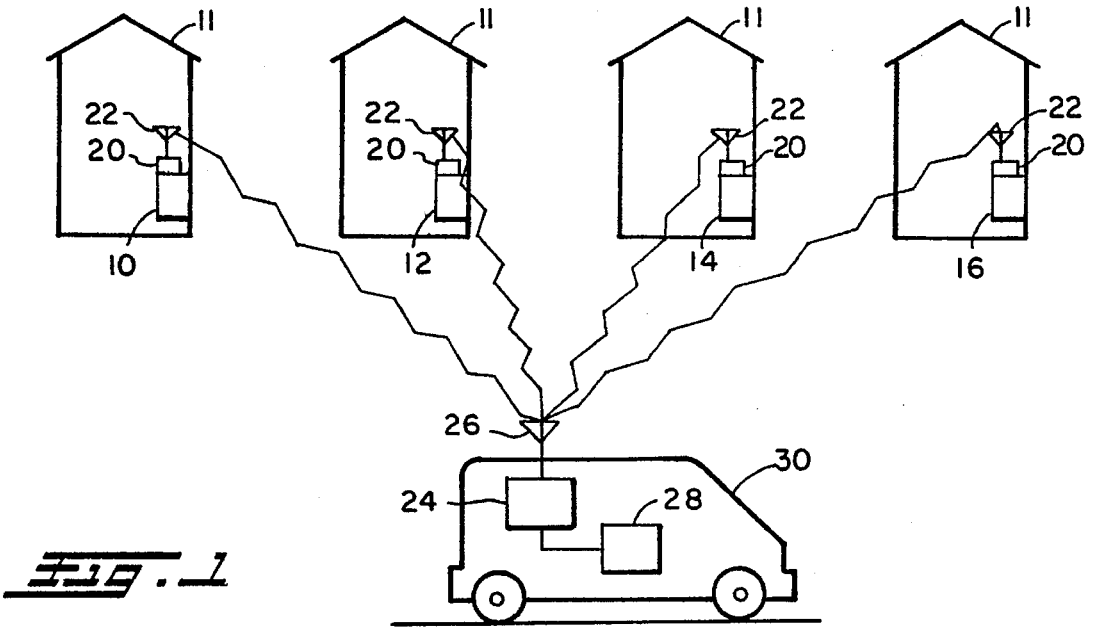
FIG. 1 is a schematic illustration disclosing the method and apparatus for communicating utility usage-related information of the present invention.

Referring to the figures, and more particularly, to FIG. 1, a preferred embodiment of the method and apparatus for reading a plurality of utility meters 10, 12, 14 and 16 is disclosed. Each of the meters 10–16 is schematically disclosed located in a structure such as a house 11. While only four meters 10, 12, 14 and 16 have been disclosed, it should be realized that many more are utilized in an actual installation. Each of the utility meters 10–16 has associated therewith a first means or meter module 20 which is adapted to provide a signal indicative of the utility usage at its associated utility meter. Each of the meter modules 20 includes an antenna 22 which is operable to transmit a signal to an antenna 26 connected to a remote receiver 24. The receiver 24 then directs the signal to a utility usage registering device 28 which stores the utility usage information.

The signal which is transmitted from the meter module 20 to the receiver 24 is indicative of the utility usage at its associated utility meter. The signal also can include information identifying the particular utility meter with which it is associated, information indicating whether the meter has been tampered with, leak detection information, and information indicating the peak usage, total utility usage, and time of use. If desired, other information could be sensed by the meter module 20 and transmitted to the receiver 24.

The utility usage registering device 28 is preferably a portable computer which receives the utility usage information, displays the information, and then stores the information. The receiver 24 and utility usage registering device 28 are adapted to be portable and can be either handheld or located in a vehicle 30 for movement. Each of the meter modules 20 transmits at a pseudo-random interval for a limited distance. The receiver 24 will only receive signals from meter modules 20 which are within a finite range which is determined by the sensitivity of the receiver 24, the strength of the signals transmitted by the meter modules 20 and the RF propagation environment. Elevation, moisture in the atmosphere, location and interfering structures such as buildings, hills, etc. all affect the RF propagation environment. Thus, by controlling the sensitivity of the receiver, only a limited number of modules 20 are capable of transmitting signals which are received by the receiver 24 at any one time to minimize the probability of preventing the receiver 24 receiving simultaneous signals from multiple meter modules 20. The vehicle 30 which carries the receiver 24 can be driven within range of the plurality of meter modules 20, and as the vehicle moves, the receiver 24 can sequentially receive signals from the plurality of meter modules 20 indicative of utility usage. Movement of the vehicle will bring some meter modules 20 into range and will allow others to become out of range so that only a finite number of modules 20 will transmit to the receiver 24 when the receiver is in a particular location.

Figure 2:
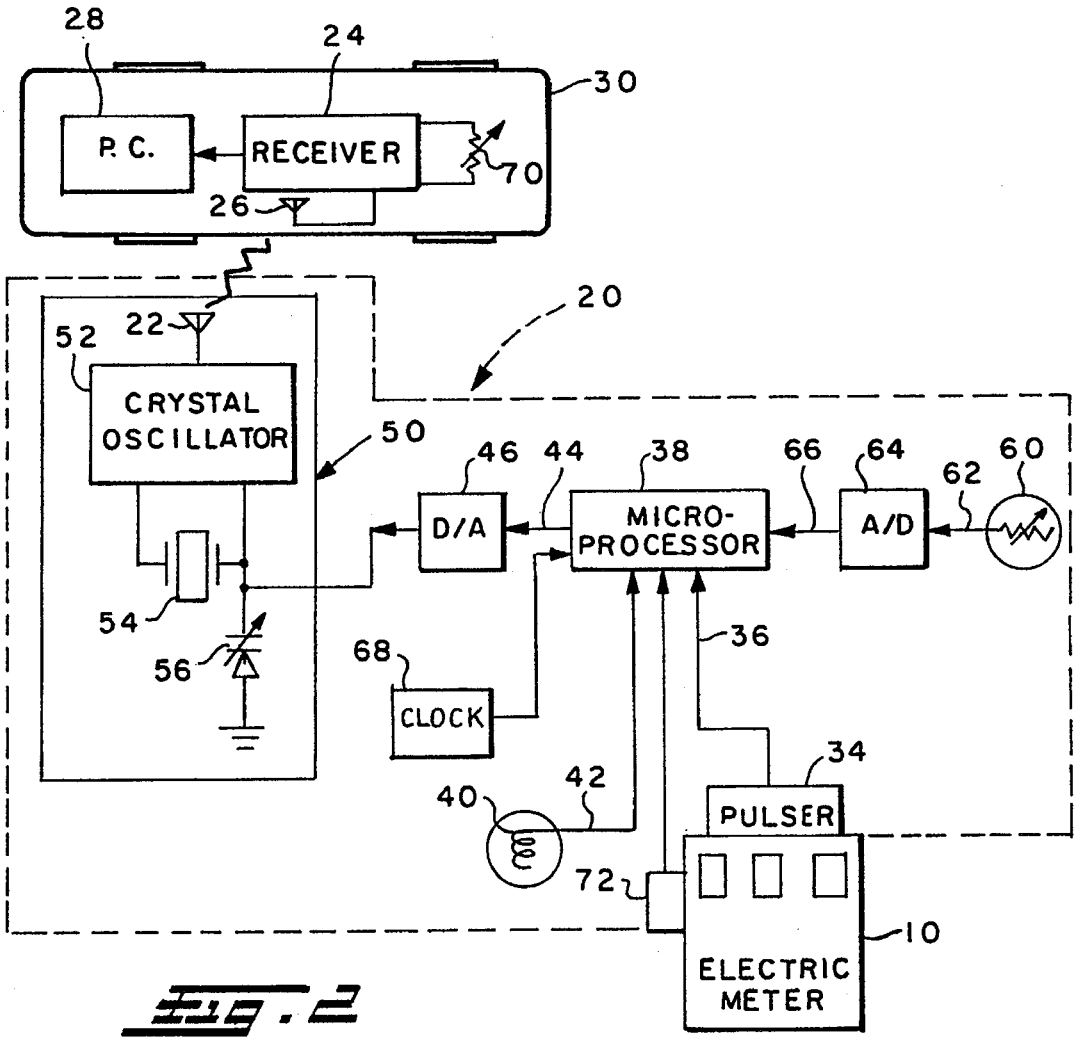
FIG. 2 is a schematic diagram more fully illustrating the construction of a meter module for communicating utility usage-related information to a utility usage registering device.
Figure 8:
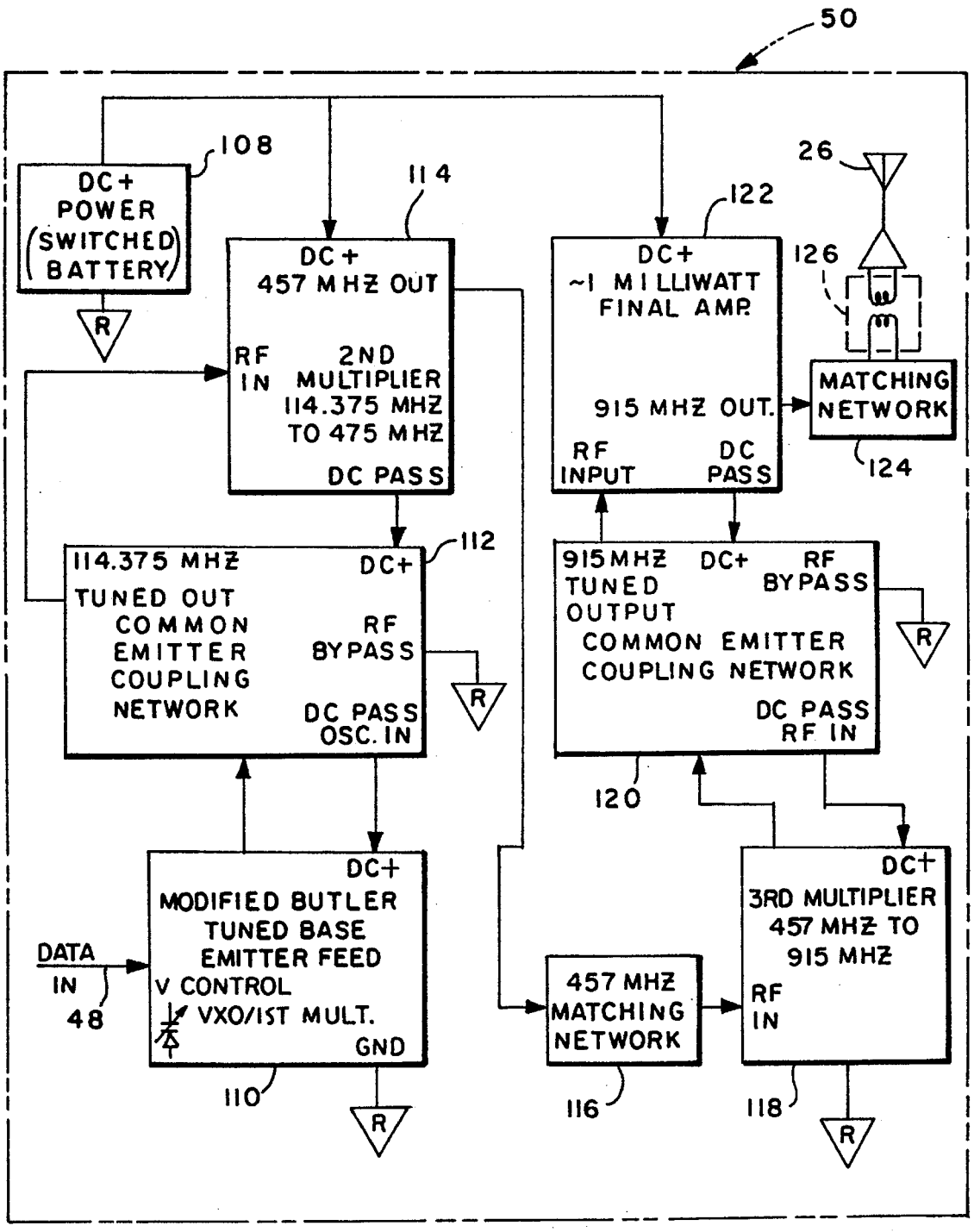
FIG. 8 discloses a further schematic diagram of a transmitter circuit for transmitting utility usage information at an accurate frequency which is particularly adapted to operate utilizing low power.

The meter module 20 disclosed in FIG. 2 is particularly adapted to sense the utility usage of an associated electric meter 10 where a source of electric power is present, but can be utilized with other types of utility meters such as water or gas. The meter module disclosed in FIG. 8 is battery powered to enable the meter module 20 to be utilized at locations in which electrical power is not present, such as in a gas or water meter. The use of a battery requires that the power drain by the meter module 20 be kept to a minimum to insure long battery life. The battery which provides the power supply can be a 3.6 volt lithium battery.

The meter module 20, as is more fully illustrated in FIG. 2, includes a pulser 34 which detects utility usage at the electric meter 10 and sends a signal over line 36 to a microprocessor 38. The pulser 34 will send a pulse to the microprocessor every time the utility meter registers the use of a predetermined amount of the metered utility, for example, every 0.1 KW hour for an electric meter, or every cubic foot for a gas or water meter. The microprocessor 38 includes a counter circuit (not illustrated) which is energized by the signal on line 36 to enable the microprocessor 38 to store therein utility usage information. Instead of a pulser, an encoder or other means could be utilized to generate a serial data train to the microprocessor 38 which is indicative of utility usage.

The microprocessor 38 can also store therein information related to the utility meter 10 with which it is associated. For example, the microprocessor could store therein information related to the user's account number and the identity of the particular meter being read. An inductive coil 40 is provided which can be sealed within the module 20 and which can have a signal induced therein which is directed along line 42 to the microprocessor 38 to program the microprocessor with information relative to the particular meter and user with which the microprocessor 38 and module 20 is associated. The pulser 34, inductive coil 40, and microprocessor 38, can be similar to that disclosed in U.S. Pat. No. 4,463,354 entitled "Apparatus for Communicating Utility Usage Related Information from a Utility Usage Location to a Portable Utility Usage Registering Device", which patent is incorporated herein by reference.

The microprocessor 38 periodically directs a signal on line 44 to a digital to analog converter 46 which outputs the signal to the input 48 of a transmitter 50. The transmitter 50 includes a crystal oscillator 52, a crystal 54, a varacter diode 56, and the antenna 22. The crystal 54 oscillates at a predetermined frequency, and the varacter diode 56 can be utilized to tune the crystal oscillator 52 and crystal 54. The crystal oscillator 52 and related components can preferably be provided on a single synthesizer chip such as MC13176 manufactured by Motorola. A voltage controlled oscillator (VCO) phase lock loop can be provided on the synthesizer chip to stabilize the output of the transmitter and allow the use of a low cost, stable, low frequency crystal 54 to generate a high frequency signal of identical stability.

Figure 7:
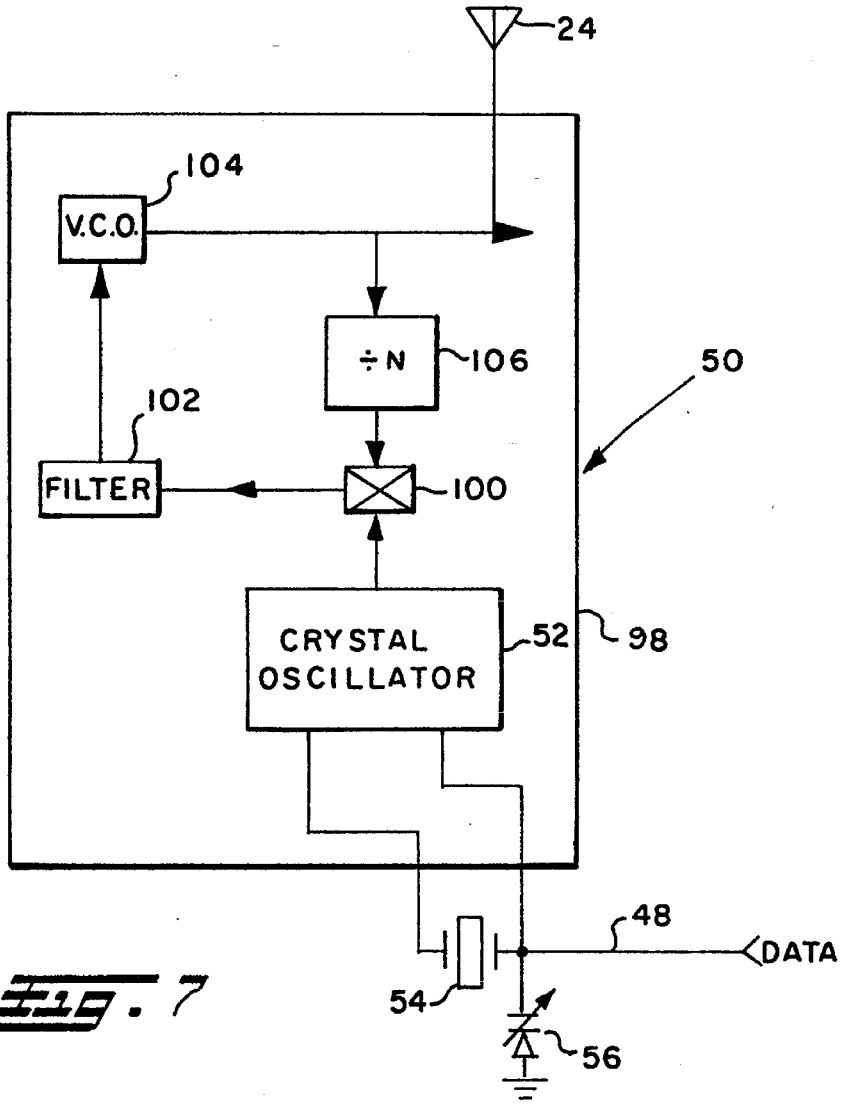
FIG. 7 more fully discloses the phase lock loop used within each transmitter.

FIG. 7 more fully discloses the transmitter 50. The transmitter 50 includes a single synthesizer chip 98 to which data is inputted via the input 48 from the D/A converter. A crystal 54 and the varacter diode 56 is connected to the chip 98 which includes the crystal oscillator 52 thereon. The chip also includes the phase lock loop which includes a phase detector 100 to which the output of the crystal oscillator signal generator 52 is directed. The output of the phase detector 100 is directed to a filter 102 whose output is directed to a voltage controlled oscillator 104. The output of the voltage controlled oscillator (VCO) is directed to the antenna 24 and back to a divide-by-N circuit 106. The phase lock loop, including the phase detector 100, filter 102, voltage controlled oscillator 104, and divide by N circuit 106, are all located within the synthesizer chip 98. The use of the phase lock loop allows the use of a stable low cost crystal to produce a stable output signal from the transmitter 50 which is important due to the very narrow frequency bands which are assigned by the FCC for utility usage transmission apparatus.

The transmitter 50 transmits a first signal indicative of utility usage information to the receiver 24 on an accurately controlled fixed frequency. In many cases, the frequency must be assigned by the FCC, is a very narrow frequency band, and must be accurately controlled so that the frequency does not wander into adjacent frequency bands. The crystal 54 and related components are temperature sensitive and vary in oscillating frequency when subjected to varying temperatures. The microprocessor 38 establishes a signal on the input 48 of the transmitter 50, which signal is a temperature compensated signal to compensate for the varying temperature of the crystal 54 and related components to enable the crystal oscillator 52 to transmit at an accurately controlled fixed frequency. The signal at the input 48 of transmitter 50 includes a first component which comprises a rapidly varying stepped voltage in a four-ary format for data transfer and a second component which comprises a slowly varying DC signal established by microprocessor 38 for temperature compensation of the transmitter 50.

Figure 5:
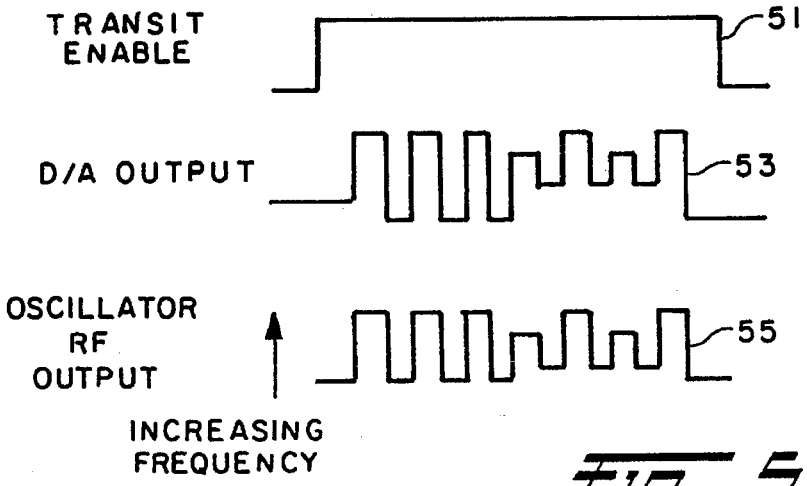
FIG. 5 illustrates a transit enable signal from the microprocessor, the output of the D/A converter and the oscillator RF output from the transmitter.

FIG. 5 discloses the input to the transmitter 50 on line 48 as including a transmit enable signal 51 and the output from the D/A converter 46 as signal 53, which is arranged in a four-ary format. The enable signal 51 and the D/A output are directed on line 48 to enable transmitter 50 and to effect a predetermined output from the oscillator circuit 52 which is illustrated at 55 in FIG. 5. The output from the oscillator is also arranged in a four-ary format to establish four levels of FM modulation to transfer the utility usage information. The four-ary format includes four distinct input voltages, signals 53, necessary to transmit the utility usage information at the correct frequency from the transmitter 50 at the correct temperature. The four-ary format of the transmitted signal allows data compression and allows more information to be transmitted in a shorter period of time than if a binary signal were utilized.

The microprocessor 38 includes a look-up table therein which includes data indicative of the correct temperature compensated signal to be directed to the input 48 of the transmitter 50 to effect oscillation of the crystal 54 and output of transmitter 50 at each of the four frequencies of the four-ary format when the transmitter 50 and its related components are at various temperatures which have been entered into the look-up table. Thus, the transmitter 50 is temperature compensated by the signal at input 48 from the microprocessor 38.

A thermister 60 is operable to sense the temperature of crystal 54 and transmitter 50 and establish a temperature signal on line 62 to an analog to digital converter 64 which directs the signal along line 66 to the microprocessor 38. The thermister 60 provides a temperature signal to the microprocessor 38 which enables the microprocessor to determine from the look-up table therein the correct temperature compensated signal, dependent upon the actual sensed temperature of the transmitter 50, to be directed to the transmitter 50 to cause the transmitter 50 to transmit at an accurate predetermined frequency. It should be realized that the temperature compensated signal is in fact four temperature compensated signals to compensate the four-ary output of the transmitter 50.

In the preferred embodiment, each individual module 20 including the transmitter 50, crystal 54, and thermister 60 associated therewith, is "burned in" at varying temperatures so that each module 20 can be individually calibrated and the look-up table in each microprocessor 38 can be individually programmed with the correct data to establish the correct temperature compensated signal at the input to the transmitter 50 when the transmitter is at various temperatures. The temperature compensated signal compensates for the nonlinearity of the thermister 60, crystal 54, and other components of the transmitter 50 which are burned in and calibrated as a unit. The individual calibration and compensation of each transmitter 50 and associated components allow for the use of lower cost components and crystals without degrading the accuracy of the transmitted signal.

The microprocessor 38 directs a first signal to transmitter 50 which causes transmitter 50 to transmit at a pseudo-random interval a first signal which is at an accurate fixed frequency, indicative of utility usage. Transmitting at a pseudo-random transmission interval prevents the receiver 24 receiving simultaneous overlapped transmission signals from a plurality of modules 20. A lock-up of transmission signals would occur when the receiver 24 receives transmissions from more than one module 20 which are equal in time and phase and by chance synchronized. Periodic transmission rather than constant transmission reduces the energy consumption of the module 20, allows same to be battery powered, and allows multiple modules 20 to transmit for short times which are spread out so as to enable the receiver to sequentially receive a plurality of signals from a plurality of modules without overlap of individual signals. Additionally, periodic transmissions are required by the F.C.C. in these transmission schemes.

If desired, a clock 68 can be provided to periodically generate a signal to tell microprocessor 38 not to transmit to prevent transmission of the first signal indicative of the utility usage. The use of clock 68 minimizes energy drain when it is not desired for the transmitter 50 to transmit a signal indicative of utility usage. For example, if it is the utility's policy to only read the meters 10 during working hours, the clock 68 can be used to prevent transmissions during non-working hours, such as at night time. This further limits the energy usage of the module 20 and the drain of power from the battery 32. Additionally, the elimination of a receiver at the meter module 22, as is utilized in other prior art systems, further significantly reduces the energy consumption and cost of the meter module 20.

FIG. 8 discloses another embodiment of a transmitter circuit 50 which can be utilized when battery power is required. The transmitter circuit disclosed in FIG. 8 is a low power transmitter and is particularly adapted to be powered by a switched battery such as at 108. If a 950.4 MHZ output is desired, which is a typical output for a preferred embodiment of the present invention, a 29.76 MHZ output from the oscillator can be inputted to the transmitter. Input data is directed along line 48 to a modified Butler tuned base emitter feed circuit. This circuit 110 functions as a times 4 multiplier with a common emitter stage providing harmonic power to the collector. If, for example, 29.7 MHZ was established at the oscillator in the modified butler tuned base emitter feed circuit 110, the output of the circuit 110 would be 118.8 MHZ. This signal is directed through a common emitter coupling network 112 which couples the output of the circuit 110 to a second stage multiplier 114 which functions as a times 4 multiplier. Thus, the 118.8 MHZ input to the multiplier 114 establishes a 475.2 MHZ output which is directed through a matching network 116 to a third stage multiplier 118 which is a times 2 multiplier. The output of the third stage multiplier would be 950.4 MHZ and is directed to a common emitter coupling network 112 which directs the output thereof to a 1 milliwatt final amplifier 122. The output of the 1 milliwatt amplifier 122 is 950.4 MHZ and is directed to a matching network, 124 and then to the antenna 22. The matching network 124 may be coupled to the antenna 22 via a coupling loop 126. The use of an inductive loop coupler 126 between the transmitter 50 and the antenna enables the antenna structure to be an environmentally sealed rugged unit resistant to physical and environmental damage to the coupling network. The matching network 124 and transmitter 50 can also be sealed when an inductive loop coupler is utilized to prevent physical and environmental damage thereto.

Figure 9:
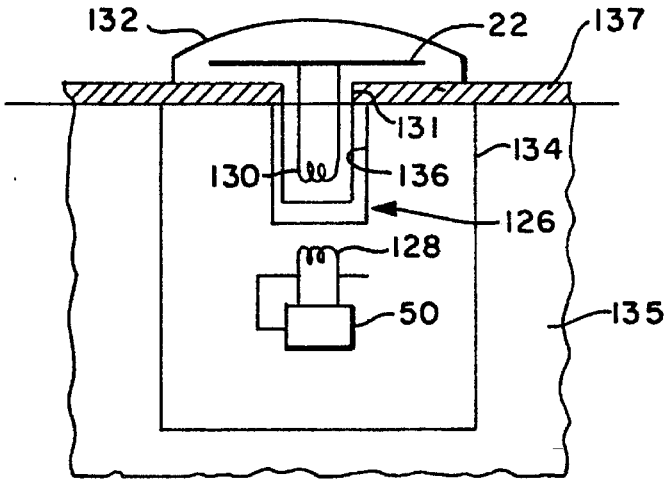
FIG. 9 illustrates an inductive loop mechanism for coupling the output of an environmentally sealed transmitter to an environmentally sealed antenna.

FIG. 9 more further illustrates the coupling of the antenna 26 to the output of the transmitter 50 via the inductive loop coupler 126. The inductive loop coupler 126 can include a coil 128 disposed adjacent to a recess 136 in a sealed housing 134 in which the transmitter assembly and its associated electronics is located and a coil 130 disposed in a sealed structure 132 in which the antenna 26 is located. The coil 130 is disposed in a projection 131 which matches the recess 136. In order to connect the inductive loop coupler 126, the coil 130 is brought into close proximity to the coil 128 by placing the projection 131 on the antenna structure 132 into the recess 136 on the housing 134 of transmitter assembly 50. The two-piece housing 134, 132 is particularly adapted for use with pit set utility meters which are located in a pit 135. The electronics and transmitter 50 located in housing 134 may be located in the pit and the antenna 22 and housing 134 may be located on the outside of the cover 137 which closes the pit. The projection 131 can be received in an opening in the pit cover 137 to enable the projection 131 to be received in the recess 136 of housing 134 to couple coils 128 and 130. Such a structure enables the antenna 22 and housing 132 to be easily removed, replaced or serviced without opening the pit cover 137 and removing the electronics and transmitter. No physical connection is provided between housings 132 and 134 and each housing is completely sealed to provide a rugged structure which is resistant to physical damage.

The meter module 20 periodically transmits signals indicative of utility usage information at pseudo-random transmission intervals. The pseudo-random time interval between which the meter module 20 transmits includes a large fixed component FI (fixed internal) which is preset and a random component PI (pseudo-random interval) which is added to the preset fixed component to define the interval between transmissions which is equal to FI+PI (see FIG. 3). Information can be programmed into the inductive coil 40 to preset the large predetermined component FI of the pseudo-random transmission interval. The random small component PI which is added to the preset fixed component FI in the microprocessor 38 is established by mathematically combining the fixed interval with the value of a continuously running counter (not illustrated) in the microprocessor 38 to generate a pseudo-random number which is used to set the pseudo-random transmission interval. The signals S from each module 20 are periodically transmitted wherein the transmission interval between transmissions is pseudo random and equal to FI+PI.

Figure 3:
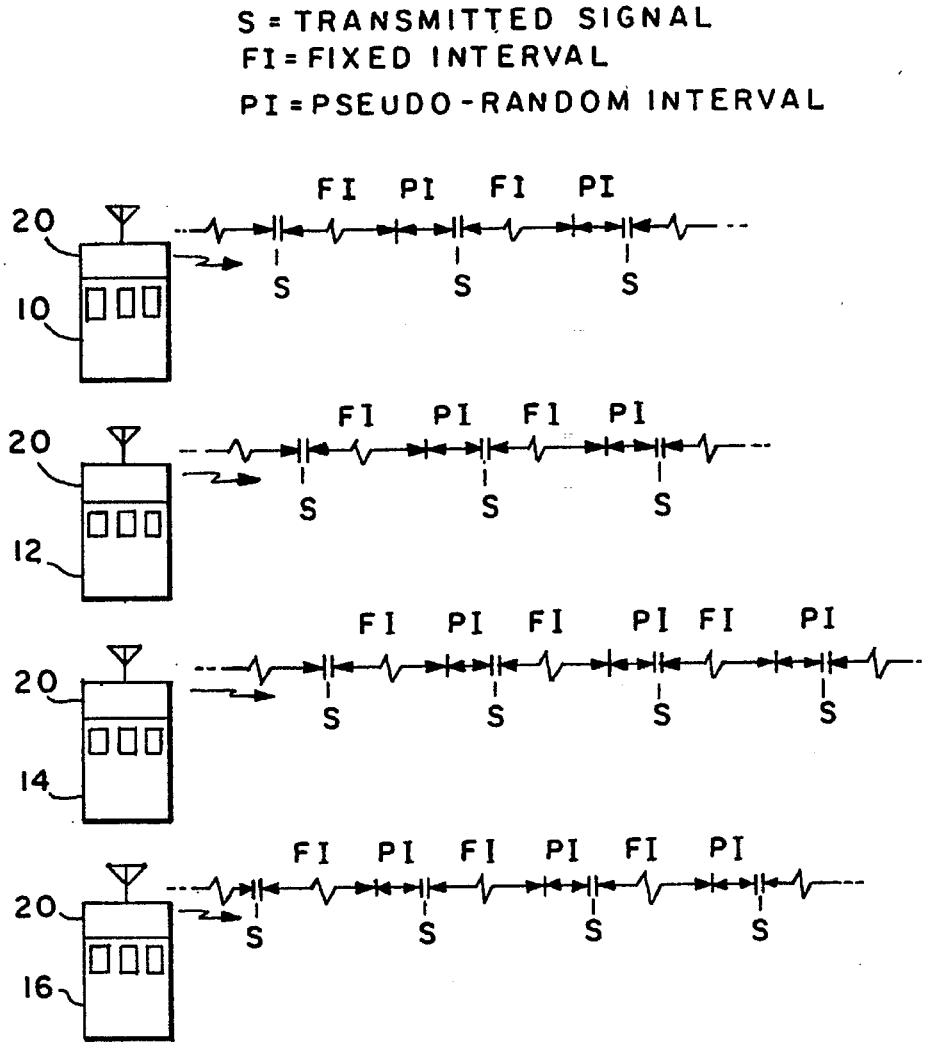
FIG. 3 schematically illustrates a plurality of meter modules, the signals transmitted thereby, and the pseudo-random interval between sequential signals.

FIG. 3 illustrates the signals transmitted by the meter modules 20 associated with utility meters 10, 12, 14 and 16. Each of the signals in FIG. 3 is transmitted at a fixed frequency controlled by the crystal 54 and each is transmitted at a pseudo-random transmission interval equal to FI+PI.

In the preferred embodiment, illustrated in FIG. 3, the fixed component of the transmission interval FI is set at approximately 10 seconds and the pseudo-random interval PI is determined by the continuously running counter in the microprocessor. The pseudo-random interval is much smaller than the fixed interval and is approximately from 5% to 15% of the duration of the fixed interval. In the preferred embodiment, the length of each signal S is less than 10 milliseconds, the fixed interval is approximately 10 seconds, and the pseudo-random interval is between 0.5 and 1.5 seconds. The pseudo-random interval PI varies from transmission to transmission depending upon the number in the continuously running counter, not illustrated.

The length of each signal S transmitted by each meter module 20 is small when compared to the pseudo-random transmission interval (FI+PI) between the periodic signals S. If two signals S are simultaneously received, the receiver 24 will disregard the simultaneous received signals and attempt to pick up the transmitted information when the next periodic signal is received from the meter module 20. If there is a 10 second transmission interval, the receiver will only have to wait an additional 10 seconds to receive the information. The pseudo-random transmission interval will prevent the next signals from being received simultaneously due to the fact that each pseudo-random transmission interval is different and random.

CLASH, which is the coincidence of transmissions from more than one meter module 20, will occur if two simultaneous signals are received by the receiver 24. CLASH can be minimized if the transmissions are short and the interval between transmissions are long. The likelihood of CLASH= $T_{transmit} \div T_{interval} \times$number of units in range. For a typical installation, the transmission time ($T_{transmit}$) will be $5\times10^{-3}$ seconds and the time between transmissions ($T_{interval}$) will be approximately 10 seconds, with typically 50 meter modules 20 in range. Thus, the typical probability of CLASH will be $2.5\times10^{-2}$. This would result in an average meter reading system reading 1,000 meters per day having perhaps 25 CLASHes per day. However, since each meter module 20 is typically in range for several transmissions, the receiver has multiple chances to receive the signal. If two signals are overlapped or CLASHed, the receiver will receive the two signals during the next transmission which will not be overlapped due to the pseudo-random transmission interval between sequential transmissions. By utilizing a random transmission interval, the meter modules 20 do not "lock in step" and continuous CLASH is minimized. Thus, one module might transmit once per 10.1 seconds and the next module might transmit once per 10.5 seconds. The pseudo-random transmission interval will vary from module to module and from one transmission to the next to minimize the likelihood of "in step" transmissions.

A gain control 70 can be connected to the receiver 24 to adjust the gain of the receiver, which adjusts its sensitivity or range. If too many signals from modules 20 are simultaneously received or CLASH is a frequent occurrence, such as might occur in a very dense installation of modules 20, such as in an apartment complex, the gain on the receiver can be adjusted to limit the number of signals received at one time and the range of the receiver 24. While the gain control 70 has been illustrated as being manually adjustable, automatic gain control could also be utilized which would provide gain control as a function of the average number of signals S received over a predetermined period of time. If a large number of signals S were received from a large number of modules 20, the gain control would automatically turn down the gain of the receiver 24.

The transmission interval for each of the meter modules 20 can be programmed into the microprocessor 38 via coil 40 at the time of installation and in a very dense installation the transmission interval can be increased to minimize CLASH. For example, in a very large apartment complex where a plurality of modules 20 are densely located, a one minute time interval could be utilized as the transmission interval. This would result in less CLASH.

The receiver antenna 26 is preferably polarized in a circular fashion while the antennas 22 on the transmitter 50 can be polarized either vertically or horizontally. The circular polarization on the receiver antenna 26 increases its sensitivity, particularly when reflections of the signal transmitted from the modules 20 occur. In the preferred embodiment, it has been found to be advantageous to utilize a circularly polarized receiver antenna 26 and a horizontally polarized antenna 22 on the transmitter 50.

A leak detection algorithm can also be included in the microprocessor 38. Leak detection is particularly advantageous for water meters and can be determined by checking water flow over a long time period to insure that there is at least one short period where no water or only a small amount of water is used. In a water installation it is assumed that there should be some periods where no or only a minimal amount of water is used, such as at night. If there are no short periods of minimal or low flow sensed over a long period such as a day or a week, it is assumed that there is a leak. In the preferred embodiment, the leak detector is included in the microprocessor 38. The microprocessor senses and stores flow information from the pulser 34 and stores the sensed flow during a weekly time period which is divided into smaller time intervals. If no flow is not sensed during at least one of the smaller time intervals, a leak signal is activated. The microprocessor 38 can be utilized to determine the presence or absence of flow during each interval of the weekly period and includes the leakage information in the signal indicative of utility usage which is directed to transmitter 50.

A tamper detecting circuit 72 can be provided adjacent to meter 10 to provide an indication if the meter is tampered with. A tamper event would occur if the meter or the modules 20 were disconnected, moved, rendered ineffective, bypassed, or if other such unauthorized events occur. Preferably, the tamper detector 72 can include one or more of the following: a mechanical motion switch; a power failure sensor to sense if the meter was unplugged; and/or a magnetic sensor to determine if the meter was subjected to unusual magnetic fields. The tamper detector 72 activates a counter in the microprocessor 38 which indexes every time a tamper event occurs. For example, if one tamper event occurs, the counter will read "1". If a second tamper event occurs, the counter will index to "2". The counter could be a three bit counter, and when "8" is reached, would then recycle back to "1". The tamper detector 72 provides a signal to the microprocessor 38 which is indicative of a tamper event and the counter in the microprocessor 38 keeps track of the tamper events. The indexed tamper signal from the microprocessor 38, along with the leak detection information, is included in the information in the signals transmitted from the transmitter 50 to the receiver 24. The receiver then loads the utility usage information, along with the tamper count and leakage information, into the personal computer 28. The personal computer can compare the tamper count sensed on the previous meter read with the tamper count sensed on the current meter read. If there is a difference in the tamper count, it will be indicative of the fact that a tamper event has been sensed by the tamper sensor 72. For example, if a meter was read and a tamper count of 1 was sensed, it could be an isolated event. If a month later the meter was again read and the tamper count was a 1, the utility could be reasonably sure that no tamper event had occurred. However, if the tamper count were 4, it would be indicative of the fact that three additional tamper events had occurred and that the meter had been tampered with and an investigation could be initiated. The tamper detecting circuit 72 is particularly advantageous when a battery is used to power modules 20 as it does not have to be reset after a tamper event and does not require a receiver to effect reset of the tamper circuit 72 which would require additional energy draining circuitry.

Figure 4:
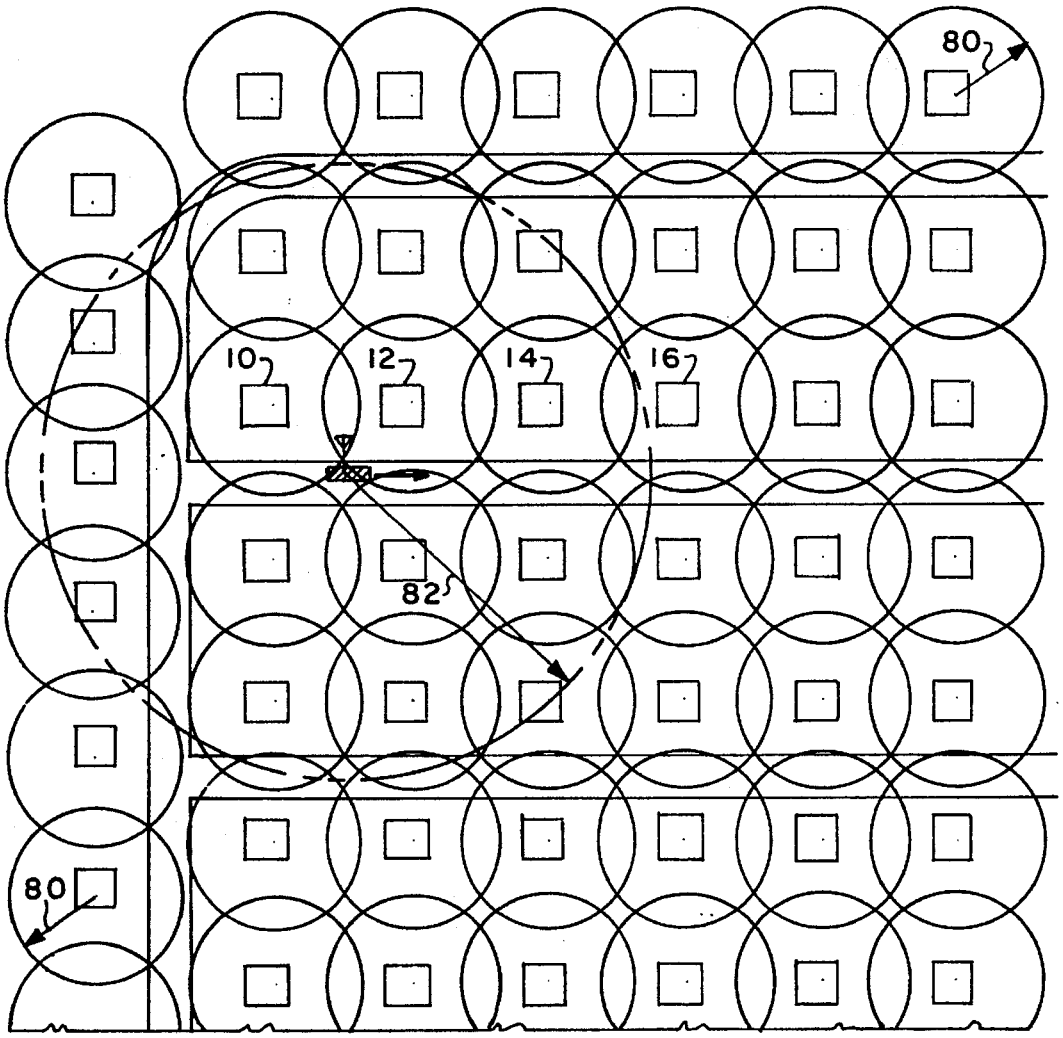
FIG. 4 schematically illustrates the operation of the meter reading system in a residential neighborhood wherein some modules are within range of the receiver and others are out of range.

FIG. 4 illustrates the sequential reading of a plurality of meters 10, 12, 14, 16, each of which has a module 20 associated therewith. Each of the meters is associated with a spaced apart location, such as a single family house. Each meter transmits a first signal indicative of utility usage, tamper events, and other information. Each signal has a transmission range which is indicated at 80. The receiver 24 has a reception range which is schematically illustrated at 82. From FIG. 3 it can be seen that only a limited number of a plurality of meters are read when the receiver 24 and vehicle 30 are in any one predetermined location. The number of meters read will be dependent on the range 82 of the receiver 24 and the range 80 of the transmitters 50 associated with the modules 20. Since the transmitters 50 transmit at transmission intervals which are long compared to the transmission period(s) of each of the modules 20, CLASH can be minimized as the receiver 24 and vehicle 30 move to sequentially read the plurality of meters.

Figure 6:
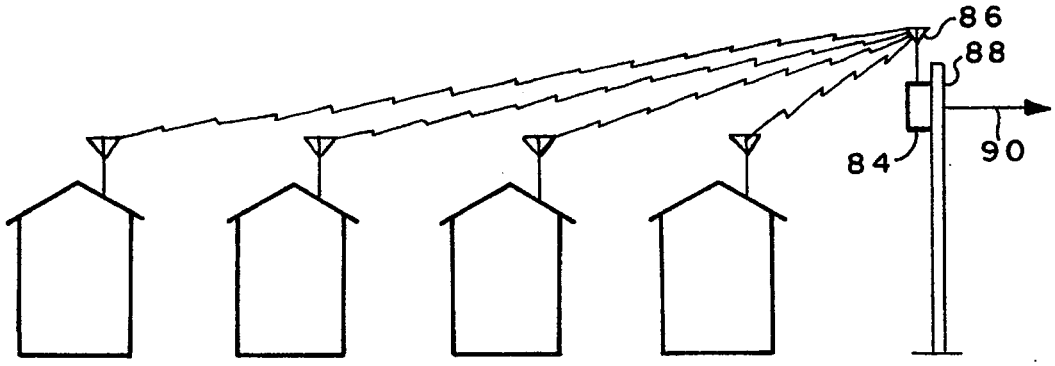
FIG. 6 illustrates a further embodiment of the present invention in which data concentrators are utilized to concentrate the flow of data from a plurality of meter modules.

FIG. 6 discloses a further embodiment of the invention wherein instead of utilizing a portable receiver, a fixed receiver 84 is utilized. The fixed receiver 84 can be utilized to periodically receive transmissions from a plurality of modules 20. The fixed receiver 84 includes an antenna 86 for receiving signals from the modules 20, and is connected via line 90 to a cable, optical or phone line or via a radio link over which the data can be transmitted from the receiver 84 to a utility usage registering device. The receiver 84 acts as concentrator, and a plurality of receivers 84 can be located throughout a city to receive information from associated meter modules 20. The data from the plurality of meter modules 20 can be transmitted to the concentrating receivers 84 which then either transmit the data via an antenna back to a central station, or transmit via phone or cable. Instead of a central station being utilized other substations could be utilized which would then further concentrate the data and forward it via radio, cable or phone to a central station.

While the microprocessor 38 has been disclosed as being programmed via a small coil 40, other manners of programming, such as an infra red signal or a direct connection, could be utilized. The coil 40 has the advantage in that it can be sealed inside the meter module 20 so that no access is required for programming. This provides a more durable module by preventing a leak to the interior of the module via physical connector devices.

From the foregoing, it should be apparent that a new and improved apparatus for communicating utility usage information at a utility usage location to a utility usage registering device 28 has been provided. The apparatus includes a first means 20 adapted to be located at a utility meter 10 to provide a first signal indicative of utility usage information, transmitter means 50 responsive to the first signal for periodically transmitting at a pseudo-random transmission interval, a second signal which is indicative of utility usage information, receiver means 24 adapted to be located remote from the utility usage location for receiving the second signal, and a utility usage registering device 28 for storing the information in the second signal which is indicative of the utility usage. The transmitter 50 is temperature compensated by the data in the microprocessor 38 lookup table to provide a temperature compensated signal to the transmitter 50. A tamper detector 72 is associated with the first means 20 for detecting the occurrence of a tamper event and the tamper signal is indexed upon the tamper detector sensing the occurrence of a tamper event. In the preferred embodiment, an inductive loop 126 is provided to couple the output of the transmitter 50 with the antenna 22.

What I claim is:

1. An apparatus for communicating utility usage information at a utility usage location to a utility usage registering device comprising first means adapted to be located at a utility usage location providing a first signal indicative of utility usage information, transmitter means responsive to said first signal for periodically transmitting at a pseudo-random transmission interval, a second signal which is indicative of the utility usage information, receiver means adapted to be located remote from said utility usage location for receiving said second signal, and a utility usage registering device associated with said receiver means for storing the information in said second signal which is indicative of the utility usage information, said transmitter means including a temperature compensated crystal oscillator for generating said second signal at an accurate, stable frequency, and further including temperature sensitive means for generating a temperature signal indicative of the temperature of said crystal oscillator, microprocessor means for storing therein data indicative of a plurality of temperature compensated signals, one of which is to be directed to said crystal oscillator to enable said crystal oscillator to generate said second signal at an accurately predetermined frequency, said microprocessor means receiving said temperature signal and generating a temperature compensated signal to be directed to said crystal oscillator from said data in said microprocessor means.

2. An apparatus for communicating utility usage information, as defined in claim 1, further including first antenna means associated with said first means and second antenna means associated with said receiver means, said first antenna means being horizontally polarized and said second antenna means being circularly polarized.

3. An apparatus for communicating utility usage information at a utility usage location to a utility usage registering device comprising first means adapted to be located at said utility usage location for providing a first signal indicative of utility usage at said utility usage location, microprocessor means for storing said first signal, and transmitter means connected to said microprocessor for periodically transmitting at a pseudo-random transmission interval a second signal to said utility usage registering device which is indicative of the utility usage at the utility usage location, further including temperature sensitive means for generating a temperature signal indicative of the temperature of said transmitter means, said microprocessor means storing therein data indicative of a plurality of temperature compensated signals to be directed to said transmitter means to enable said transmitter means to generate said second signal at an accurate predetermined frequency, said microprocessor means receiving said temperature signal and generating a temperature-compensated signal to be directed to said transmitter means.

4. An apparatus for communicating utility usage information at a utility usage location to a utility usage registering device comprising a first means adapted to be located at said utility usage location for providing a first signal indicative of utility usage at said utility usage location, a microprocessor means for storing said first signal, and a temperature compensated transmitter means connected to said microprocessor for periodically transmitting a second signal to a utility usage registering device which is indicative of the utility usage at the utility usage location, further including temperature sensitive means for generating a temperature signal indicative of the temperature of said transmitter means, said microprocessor means storing therein data indicative of a plurality of temperature compensated signals to be directed to said transmitter means to enable said transmitter means to transmit said second signal at an accurate predetermined frequency, said microprocessor means receiving said temperature signal and generating a temperature compensated signal which is dependent upon said temperature signal from said data in said microprocessor means.

5. An apparatus for communicating utility usage information at a utility usage location to a utility usage registering device, as defined in claim 4, further including a tamper detector associated with said first means providing said first signal indicative of utility usage information, said tamper detector detecting the occurrence of a tamper event at the utility usage location and generating a tamper signal to said first means, said tamper signal being indexed upon said tamper detector sensing the occurrence of each tamper event, said first means providing said first signal, which includes as a component thereof, said indexed tamper signal.

6. An apparatus for communicating utility usage information at a utility usage location to a utility usage registering device comprising a first means adapted to be located at said utility usage location for providing a first signal indicative of utility usage at said utility usage location, microprocessor means responsive to said first signal, transmitter means having an antenna connected to said microprocessor means for periodically transmitting on said antenna a second signal to a utility usage registering device which is indicative of the utility usage at the utility usage location, an inductive loop coupler including a first inductive loop connected to the output of said transmitter means and a second inductive loop connected to said antenna, a first housing for supporting said first inductive loop therein, said first housing being sealed to protect said first inductive loop from environmental degradation, a second housing for supporting said second inductive loop therein, said second housing being sealed to protect said second inductive loop from environmental degradation, and wherein said first housing is adapted to be disposed contiguous to said second housing to couple said first inductive loop to said second inductive loop to enable said inductive loop coupler to connect the output of said transmitter means to said antenna.

7. An apparatus for communicating utility usage information at a utility usage location to a utility usage registering device, as defined in claim 6, further including a tamper detector associated with said first means, said tamper detector detecting the occurrence of a tamper event at said utility usage location and generating a tamper signal to said microprocessor means, said tamper signal being indexed upon said tamper detector sensing the occurrence of each tamper event, said microprocessor means generating said second signal which includes as a component thereof, said indexed tamper signal.

8. An apparatus for communicating utility usage information at a utility usage location to a utility usage registering device, as defined in claim 6, wherein said first housing includes a recess therein, said second housing includes a projection thereon which is complementary to said recess in said first housing and wherein said projection on said second housing is received in said recess in said first housing to locate said first inductive loop adjacent to said second inductive loop to couple said first and second inductive loops.

9. A battery operated apparatus for communicating utility usage information at a utility usage location to a utility usage registering device comprising first means, energized by the battery, located at the utility usage location for providing a first signal indicative of utility usage at the utility usage location, a tamper detector associated with said first means for detecting the occurrence of a tamper event at the utility usage location and generating a tamper signal to the first means, said tamper signal being indexed upon said tamper detector sensing the occurrence of each tamper event, microprocessor means for storing said first signal, transmitter means powered by the battery and connected to the microprocessor for periodically transmitting a second signal to a utility usage registering device which is indicative of the utility usage at the utility usage location and said indexed tamper signal, and temperature sensitive means for generating a temperature signal indicative of the temperature of said crystal oscillator, said microprocessor means storing therein data indicative of a plurality of temperature compensated signals, one of which is to be directed to said crystal oscillator to enable said crystal oscillator to generate said second signal at an accurately predetermined frequency, said microprocessor means receiving said temperature signal and generating a temperature compensated signal which is dependent upon said temperature signal to be directed to said crystal oscillator from said data in said microprocessor means.

* * * * *